US011339755B2

(12) United States Patent
Jackson

(10) Patent No.: US 11,339,755 B2
(45) **Date of Patent: *May 24, 2022**

(54) HIGH VOLUME ELECTRONIC FUEL INJECTION SYSTEM

(71) Applicant: Donald John Jackson, Oceanside, CA (US)

(72) Inventor: Donald John Jackson, Oceanside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/337,371

(22) Filed: Jun. 2, 2021

(65) Prior Publication Data

US 2021/0293213 A1 Sep. 23, 2021

Related U.S. Application Data

(63) Continuation of application No. 17/209,213, filed on Mar. 22, 2021, now Pat. No. 11,047,351.
(Continued)

(51) Int. Cl.

| | |
|---|---|
| ***F02M 59/34*** | (2006.01) |
| ***F02M 59/20*** | (2006.01) |
| ***F02M 37/00*** | (2006.01) |
| ***F02M 51/04*** | (2006.01) |
| ***F02M 65/00*** | (2006.01) |
| ***F02M 41/12*** | (2006.01) |

(Continued)

(52) U.S. Cl.
CPC ..... *F02M 51/04* (2013.01); *F02D 41/3845* (2013.01); *F02D 41/3854* (2013.01); *F02M 37/0064* (2013.01); *F02M 41/124* (2013.01); *F02M 59/20* (2013.01); *F02M 59/34* (2013.01); *F02M 59/447* (2013.01); *F02M 63/0245* (2013.01); *F02M 65/00* (2013.01); *F02D 2200/0418* (2013.01); *F02D 2200/0614* (2013.01)

(58) Field of Classification Search
CPC ..... F02D 41/3845; F02D 41/3854; F02D 2200/0418; F02D 2200/0614; F02M 37/0052; F02M 37/0064; F02M 41/124; F02M 51/04; F02M 59/34; F02M 59/447; F02M 63/0245
USPC ..... 123/446, 458, 462, 464, 465, 510, 515
See application file for complete search history.

(56) References Cited

U.S. PATENT DOCUMENTS

| | | |
|---|---|---|
| 3,935,851 A | 2/1976 | Wright et al. |
| 4,327,684 A | 5/1982 | Sami et al. |

(Continued)

*Primary Examiner* — Erick R Solis
(74) *Attorney, Agent, or Firm* — Burdick Patents, P.A.; Sean D. Burdick

(57) ABSTRACT

Electronic fuel injection for an internal combustion engine maintains an operator-specified air-to-fuel ratio during engine operations in high-speed, high-volume, mixed fuel applications. A microprocessor-based controller executes a program stored in memory to calculate a fuel flow value as a function of the specified air-to-fuel ratio and specified density ratio of mixed fuels. The controller outputs a control signal to a variable fuel flow relief valve and receives feedback from an engine fuel flow sensor. The controller adjusts the control signal until the feedback matches the fuel flow value. The program optimizes the fuel flow value by accounting for engine air flow, water vapor density, and dry air density effects in the calculation, based on signals received by the controller from various environmental sensors. The system has particular application in dragster engines that burn a mixture of nitromethane and methanol.

20 Claims, 5 Drawing Sheets

Related U.S. Application Data

(60) Provisional application No. 62/992,838, filed on Mar. 20, 2020.

(51) Int. Cl.

| | |
|---|---|
| ***F02D 41/38*** | (2006.01) |
| ***F02M 59/44*** | (2006.01) |
| ***F02M 63/02*** | (2006.01) |

(56) References Cited

U.S. PATENT DOCUMENTS

| | | | |
|---|---|---|---|
| 4,348,998 | A | 9/1982 | Stumpp |
| 4,562,810 | A | 1/1986 | Miyaki |
| 6,102,005 | A | 8/2000 | Kasen et al. |
| 8,733,298 | B2 | 5/2014 | Haskara et al. |
| 9,638,126 | B2 | 5/2017 | Vosburg |
| 2007/0119390 | A1 | 5/2007 | Herrmann et al. |
| 2010/0059020 | A1 | 3/2010 | Serai et al. |
| 2017/0248094 | A1 | 8/2017 | Zimmer et al. |

HIGH VOLUME ELECTRONIC FUEL INJECTION SYSTEM

This application claims priority to U.S. Provisional Application 62/992,838 that was filed on Mar. 20, 2020 and which is fully incorporated herein by reference.

BACKGROUND OF THE INVENTION

Field of the Invention

The present invention relates generally to fuel injection systems for internal combustion engines, and more specifically to an electronic fuel injection system that optimizes the air-to-fuel ratio in a dragster engine as engine rpm increases after achieving maximum torque.

Description of Related Art

Fuel injection systems for internal combustion engines may be either mechanically controlled or electronically controlled. For high performance automotive applications, such as in race cars or dragsters, mechanical fuel injection is usually preferred, because it can handle much larger fuel flow and pressure than a conventional electronic fuel injection.

A main limitation of mechanical fuel injection is that its flow rate is linearly proportional to engine rpm. The linear relationship works well until the engine reaches its peak torque, at which point the engine is operating near maximum efficiency. Accelerating beyond this point results in a decrease in torque, so that higher power output depends on the engine's ability to increase speed. In this high-speed operating region, the fuel-to-speed curve for optimal efficiency becomes non-linear, with diminishing fuel flow needed to support higher speeds. Thus, after reaching peak torque, demanding more speed from mechanical fuel injection results in delivery of excessive fuel to the engine and a significant loss of fuel efficiency.

In drag-racing applications, the delivery of excess fuel to the engine running at high speed can have dire consequences. Air flow to the engine is limited by the size of the intake scoop. At speeds above 6500 rpm the air flow maxes out and will start to fall off as it approaches 8000 rpm. This causes the air-to-fuel mixture to run rich and at a higher density. Under these conditions, fuel such as nitromethane can combust prematurely under compression and before the valve reaches its top dead center position for ignition, leading to catastrophic engine failure.

An improvement is needed in high volume fuel injection to optimize fuel efficiency, especially for race cars and dragsters that continue to accelerate after the engine has achieved its maximum torque.

SUMMARY OF THE INVENTION

The present invention overcomes the inherent inefficiency of mechanical fuel injection systems by implementing an automated self-correcting electronic fuel injection (EFI) system. The EFI system disclosed herein employs a novel feedback control scheme to adjust automatically the position of a fuel relief valve to vary the air-to-fuel ratio over a broad range of engine rpm to optimize engine efficiency. Engine efficiency is optimized by an electronic control unit (ECU) executing an algorithm capable of controlling fuel injection by delivering fuel to satisfy an operator-specified air-to-fuel ratio regardless of speed and torque conditions.

In one embodiment, an electronic fuel injection system for an internal combustion engine includes a fuel pump having an outlet and having an inlet in fluid communication with a fuel tank, a throttle valve coupled between the outlet of the fuel pump and an intake manifold of the engine, a throttle bypass line coupled to the outlet of the fuel pump upstream of the throttle valve, and an electrically controlled variable flow valve coupled between the bypass line and the fuel tank. The system also includes an ECU having a microprocessor, memory, and an output electrically coupled to the variable flow valve. The memory stores a program executable by the microprocessor. Sensors including a fuel flow sensor is installed downstream of the throttle valve, and a humidity sensor, a pressure sensor, a temperature sensor, and air flow sensor are also installed on the engine or engine chassis to monitor operating and environmental parameters and send sensed values to the ECU. The program when executed generates an optimal fuel flow value as a function of an operator-specified air-to-fuel ratio and one or more of sensed humidity, sensed pressure, sensed temperature, and sensed air flow signals. The ECU controls fuel flow through the variable flow valve so that fuel flow sensed by the fuel flow sensor matches the optimal fuel flow value. The operator-specified air-to-fuel ratio is a dimensionless number determined by the operator, and that ratio is maintained for all engine operating conditions by responsive ECU control of the variable flow valve. According to the invention, for implementations where engine fuel is composed of a mixture of fuels, the operator may also specify a ratio of a fuel densities for fuels that that compose the mixture, and the optimal fuel flow value is also a function of the fuel density ratio.

In another embodiment, a system for controlling electronic fuel injection for an internal combustion engine includes the following components: an ECU having a microprocessor, memory, an output configured for transmission of a variable control signal, and an input configured for receiving a feedback signal. The memory in the ECU stores a program executable by the microprocessor. The program is configured to generate an optimal fuel flow value as a function of (1) an operator-specified air-to-fuel ratio written to the memory and (2) an operator-specified ratio of a first fuel density to a second fuel density, also written to the memory. The ECU is configured to vary the output of the variable control signal until the feedback signal matches the optimal fuel flow value. The system may further include a proportional electrical relief valve configured to receive the variable control signal, and a fuel flow sensor configured to transmit the feedback signal to the input. In one implementation, the operator-specified ratio represents a ratio of nitromethane density to methanol density.

Another embodiment of the invention is a method for optimizing fuel flow in an internal combustion engine. The method includes the following salient steps: specifying, for a fuel mixture comprising a first fuel and a second fuel, a ratio of the density of the first fuel to the density of the second fuel, specifying a ratio of density of air to density of the fuel mixture, and sensing air flow to the engine. The method then calculates a fuel flow value as a function of the ratio of the density of the first fuel to the density of the second fuel, the desired ratio of density of air to density of the fuel mixture, and the sensed air flow, and then adjusts flow of the fuel mixture through a variable flow valve to match the calculated fuel flow value. Related methods include steps for sensing additional engine operating or environmental parameters such as relative humidity, atmospheric pressure, and engine manifold temperature, and calculating the fuel flow value as a function of one or more of the sensed humidity, sensed pressure, and sensed temperature.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments for an advanced, high-volume electronic fuel injection (EFI) system. The EFI system disclosed herein employs a novel feedback control scheme to adjust automatically the position of a fuel relief valve to vary the air-to-fuel ratio over a broad range of engine rpm to optimize engine efficiency. Engine efficiency is optimized by an electronic control unit (ECU) executing an algorithm to control fuel injection in linear proportion to engine rpm until maximum torque is achieved, and thereafter at higher rpm by delivering fuel in nonlinear proportion to rpm to match a predetermined optimal fuel flow curve. The invention is particularly well suited for use in high performance racing cars and dragsters, though the invention is in no way so limited, as it has broad application to fuel injection systems for internal combustion engines in general.

Figure 1:
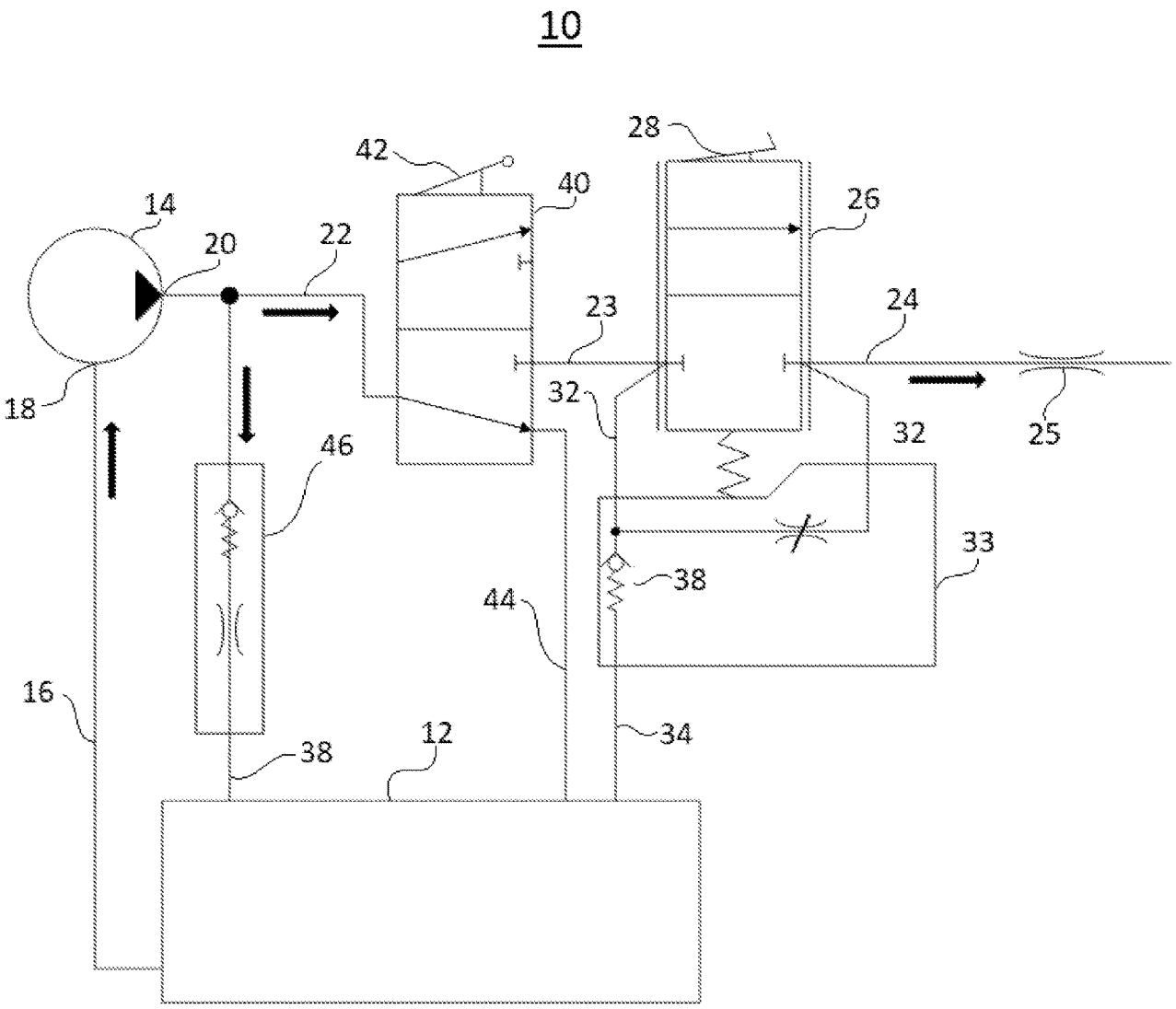
FIG. 1 (Prior Art)
FIG. 1 is a block diagram of a conventional mechanical fuel injection system for an internal combustion engine.

FIG. 1 is a block diagram of a conventional mechanical fuel injection system 10 for an internal combustion engine. The configuration of system 10 is commonly used in engines that are customized for drag racing. Salient components of system 10 are described herein to provide additional context for the present disclosure. A fuel tank 12 provides a source for hydrocarbon-based fuel for system 10. A pump 14 is configured within system 10 to draw fuel from the fuel tank 12 through a fuel line 16 into pump inlet 18. Pump 14 is typically a positive displacement pump that is mechanically driven by the cam shaft of the engine. When energized, pump 14 delivers fuel through its outlet 20 and through fuel lines 22, 23, 24 toward the engine intake manifold or nozzles 25. In some configurations, the pump 14 can be driven at twice the speed of the cam shaft.

A throttle valve 26 controls the amount of fuel from fuel line 23 that reaches the nozzles 25 by manual adjustment of a lever or pedal 28. When the pedal 28 is fully actuated, the throttle is "opened" and all of the fuel flowing in line 23 is passed through the throttle valve 26 to fuel line 24. When the pedal 28 is partially depressed (throttle partially open), fuel from line 23 flows via line 24 to the nozzles 25 in proportional to the displacement of the pedal. When the pedal 28 is not depressed, the throttle is closed and an adjustable idle control circuit 33 ensures that a minimum amount of fuel bypasses the throttle valve 26 via fuel line 32 to keep the engine running at idle, while diverting any excess fuel back to the fuel tank 12 via line 34. A check valve 36 prevents fuel flow from tank 12 in the reverse direction.

A fuel safety shutoff valve 40 is typically installed between the pump 14 and the throttle valve 26. In the event of emergency, an operator can manually actuate the switch or lever 42 and divert the fuel flow in line 22 to line 44 and directly into the fuel tank 12 to cut off the supply of fuel to the engine.

Because the pump speed is proportional to engine speed, the relationship between engine speed and fuel flow is generally linear. As the throttle valve is opened, engine speed increases, which increases fuel flow, and the optimal fuel efficiency is achieved through this linear relationship. However, once the engine reaches its peak torque, at higher rpm (the "high-speed" region) optimal engine efficiency follows a nonlinear speed-to-fuel-flow curve, with a diminishing amount of fuel flow needed to support higher speeds. That is, to maintain optimal efficiency in the high-speed region, fuel flow must be reduced in a nonlinear manner with respect to engine rpm.

System 10 includes a wide open throttle controller 46, which provides a means for mechanical control of fuel injection in the high-speed region. Controller 46 includes a spring-loaded check valve configured to open when fuel pressure acting against the spring exceeds the restoring force of the spring. Under sufficient fuel pressure, a portion of the fuel exiting the pump 14 will be automatically diverted to the fuel tank 12 via line 38. The spring restoring force in controller 46 is tunable, to allow a mechanic to vary the response of the controller 46 for a particular operating condition of the engine. In a drag racing application, for example, anticipating that the engine will be throttled open to achieve the highest possible rpm, the mechanic can tune the controller 46 to begin opening its check valve when fuel pressure corresponds to peak torque so that fuel flow to the engine nozzles will begin to level off as speed increases from that point forward. This leveling off of fuel flow at high rpm improves fuel efficiency, but fails to optimize efficiency because of the inherent difficulty in matching the linear response of the spring constant in controller 46 to the nonlinear speed-to-fuel-flow optimization curve.

Figure 2:
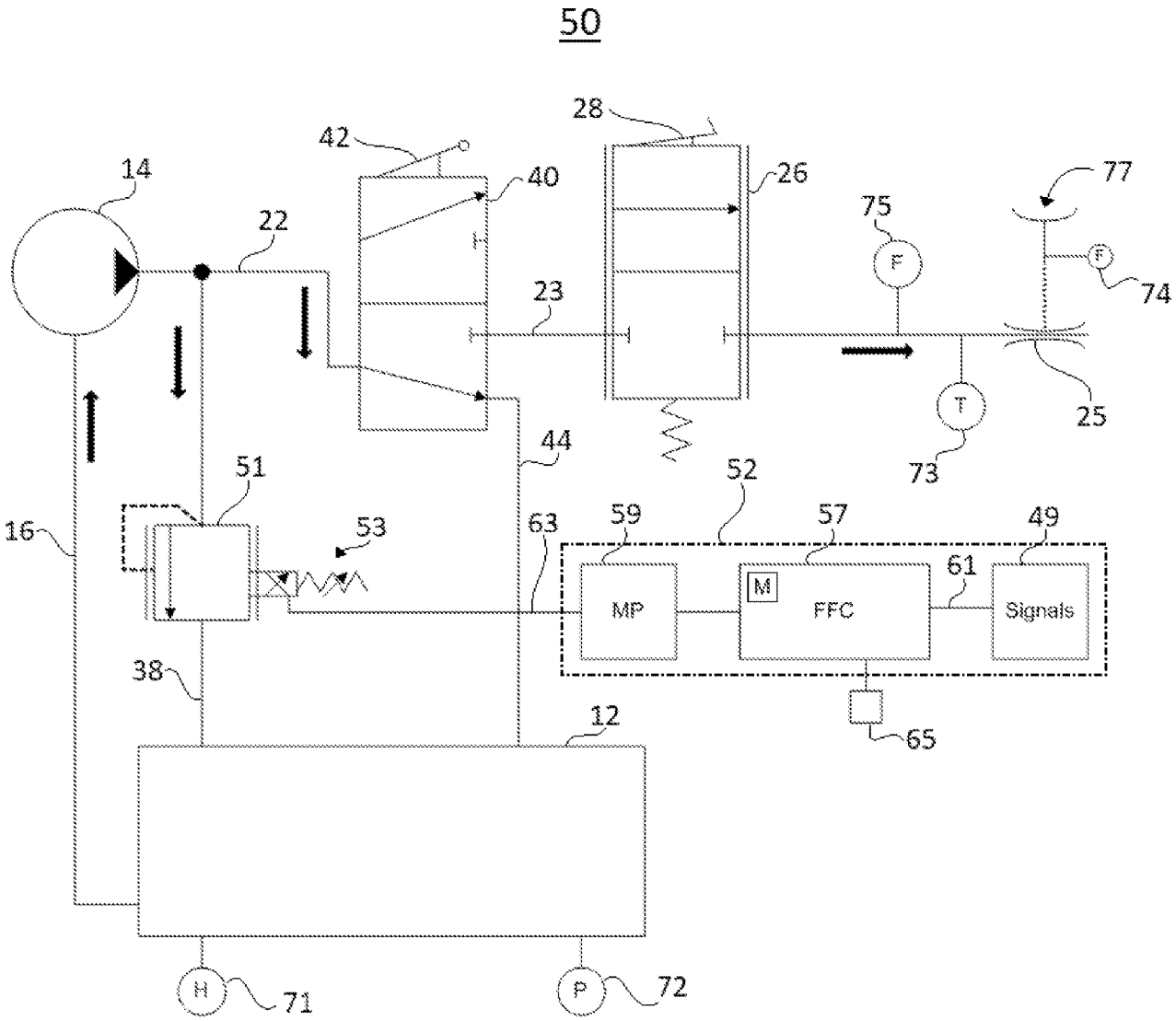
FIG. 2 is a block diagram of one embodiment according to the invention for a high volume electronic fuel injection system for an internal combustion engine.

FIG. 2 shows a block diagram of one embodiment according to the invention for a high volume electronic fuel injection system 50 for an internal combustion engine. System 50 is characterized by proportional electrical relief valve 51, and by a data acquisition and processing loop that 52 includes sensor signals 49, memory (M) 57, and an engine control unit (ECU) 59. In one embodiment, memory 57 and ECU 59 may be integrated as a single component, such as a microprocessor and programmable memory formed on a single chip. A user interface port 65 (wired or wireless) provides operator access to the data acquisition and processing loop 72. System 50 also includes the following instrumentation that generates sensor signals 49: a humidity sensor 71, a barometric pressure sensor 72, an engine manifold temperature sensor 73, an air speed sensor 74, a fuel flow sensor 75. Sensors 71 and 72 are shown mounted to tank 12 for illustration purposes only, as these sensors may be mounted to any convenient location on the engine or vehicle chassis. An air inlet or air scoop 77 defines a constant inlet area for directing air to the engine nozzles for combustion. The balance of components in system 50 may be identical in form and function to identically numbered components of system 10.

Each of the sensors 71, 72, 73, 74, 75 may be a transducing device of known design configured to continuously monitor a particular operating parameter associated with the engine, and transmit an electrical representation of the instantaneous value of that parameter to the data acquisition and processing loop that 52. The output signals from the various sensors 55 may comprise all or part of the engine operating and environmental data received as sensor input data 61 and stored in memory 57. The data acquisition and processing loop 52 may also receive data by manual entry via user interface 65 for storage in memory 57. The manual input data may include, but is not limited to: fuel type, fuel ratio in blended fuel, air inlet area, and desired air-to-fuel ratio ($AF_D$). In other embodiments, in place of data entry by automatic sensing, numerical values may be manually measured and entered manually. For example, percent relative humidity, barometric pressure, and other parameters that are not expected to vary significantly during engine run time may be manually measured and entered. The fixed data may be entered into the memory M using any known wired or wireless user interface, such as a laptop computer or mobile phone running a customized application. The data acquisition and processing loop 52 is programmable, so that its memory 57 and the control algorithm for calculating fuel flow may be accessed and updated. For this purpose, loop 52 is equipped with electronic communication ports or a wireless receiver as part of the user interface 65.

The ECU 59 is configured to read and write all of the acquired data to the memory 57, and also to execute a fuel flow control algorithm stored in memory 57 that uses the acquired data as inputs to the algorithm. The output of the control algorithm is a control signal 63 sent by the ECU 59 to the proportional electrical relief valve 51. For example, control signal 63 may be a 0-12 VDC or 0-24 VDC signal, to maintain or adjust relief valve position.

When executed during engine operation, the control algorithm calculates the amount of fuel flow to the engine nozzles ($FF_E$) in line 24 that is needed to achieve and maintain the desired air-to-fuel ratio ($AF_D$) entered by the operator, over all ranges of engine speed, based on the sensor input data 61 and the manually entered data. In a basic embodiment, the control algorithm calculates $FF_E$ as a function of (1) the desired air-to-fuel ratio, $AF_D$, for the particular fuel being used, (2) the air flow to the engine, $AF_E$, (3) water vapor density, $D_V$, and (4) air density, Do. $FF_E$ may also be referred to herein as the optimal fuel flow.

In an embodiment of the invention in an application for a dragster engine that uses a blend of nitromethane and methanol as engine fuel, the control algorithm may have the following form:

$$FF_E=[AF_E*((Y1*D_V)+(Y2*D_0))]/[AF_D*((Y3*NM\%)+(Y4*(100-NM\%)))]$$

where:

$FF_E$ is fuel flow to the engine in gpm;

$AF_E$ is air flow to the engine in $ft^3$/min;

$D_V$ is water vapor density in $lbs/ft^3$;

$D_0$ is dry air density in $lbs/ft^3$;

$AF_D$ is the desired air-to-fuel ratio, a dimensionless number;

NM % is the density ratio of nitromethane to methanol in the fuel mixture; and constants Y1=about 18; Y2=about 137.885; Y3=about 5.776; and Y4=about 2.1095.

In one implementation of the above algorithm, the fuel comprises a mixture by density of 90% nitromethane and 10% methanol, where NM %=90. Constants Y1, Y2, Y3, and Y4 will vary depending on the type of fuel used, due to stoichiometric properties. The values given for each of these constants are approximate values, for fuel composed of the specified NM % ratio of nitromethane and methanol. In practice the exact numerical value for each constant will vary, such that the term "about" should be understood to encompass a tolerance commonly accepted in the relevant field. In one example, that tolerance is plus-or-minus ten percent.

ECU 59 uses a control loop to ensure that the calculated value for $FF_E$ is delivered to the engine to maintain $AF_D$ as engine speed and other sensed parameters change. The control loop includes ECU 59, control signal 63, proportional electrical relief valve 51, and the fuel flow sensor 75. Using methods familiar to those skilled in the art of electronic control, ECU 59 compares the calculated value $FF_E$ to the sensed value of fuel flow, $F_S$, received from feedback sensor 75. If $FS>FF_E$, ECU 59 adjusts the magnitude of the control signal 63 to cause relief valve 51 to increase fuel flow through line 38, to thereby reduce the flow in line 24. Or, if $FS<FF_E$, ECU 59 adjusts control signal 63 to cause relief valve 51 to decrease fuel flow through line 38, to thereby increase the flow in line 24. Using a control technique such as PID, the ECU 59 will cause FS to converge rapidly to $FF_E$, and to track $FF_E$ as the calculated result for $FF_E$ changes during engine operation.

Figure 3:
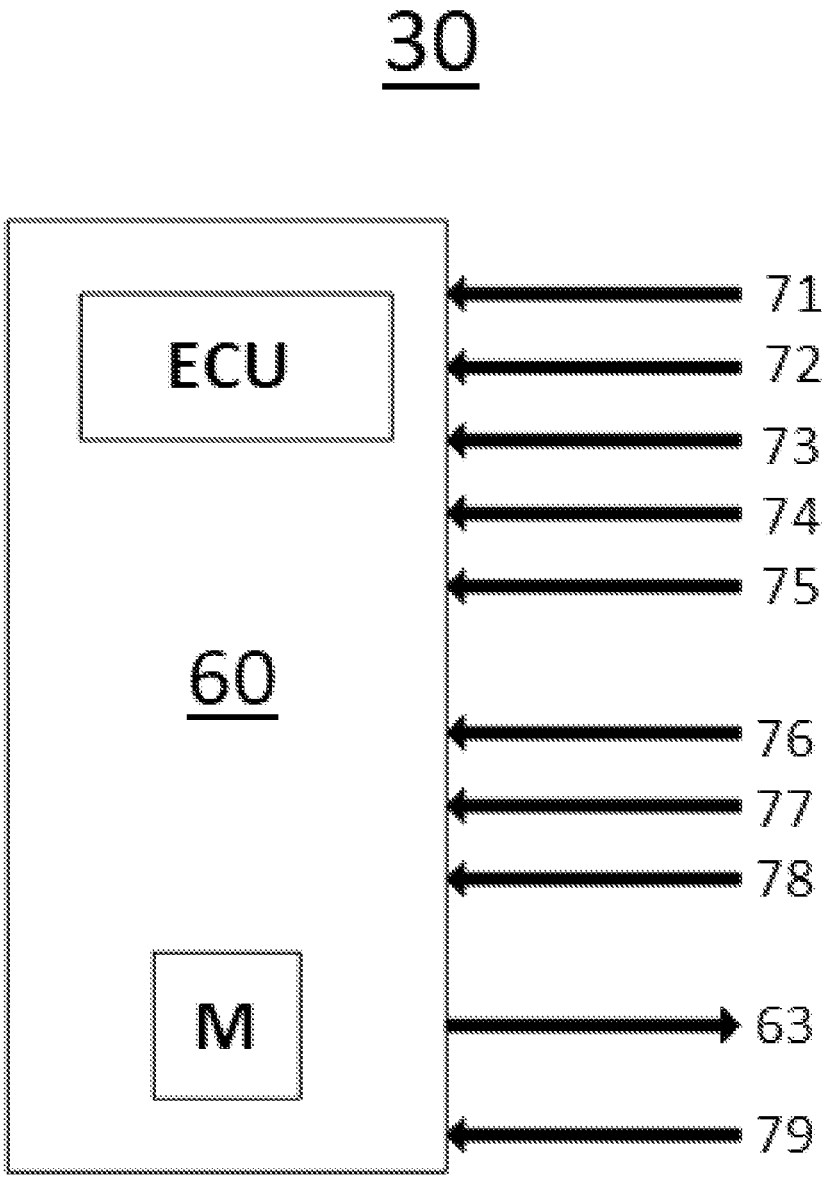
FIG. 3 is a block diagram of one embodiment of a control scheme according to the invention for controlling the air-to-fuel ratio for an internal combustion engine to optimize fuel efficiency.

FIG. 3 shows a block diagram of one embodiment of a control scheme according to the invention for controlling the air-to-fuel ratio for an internal combustion engine to optimize fuel efficiency. In this embodiment, the memory 57 and ECU 59 are integrated in a single control module 60. Each of the communication lines shown entering or leaving control module 60 represents an electrical connection to a pin contact on the module. In this example, there are five inputs received from sensors 49 installed on or about the engine, which sensors include: relative humidity sensor 71, barometric pressure sensor 72, engine manifold temperature sensor 73, air speed sensor 74, e.g. a pitot tube, and fuel flow sensor 75. There are also three inputs which in this example are received by manual entry: ratio 76, also referred to herein as NM %, which specifies a density ratio of one fuel to another fuel in a fuel mixture; inlet area 77, which specifies the area of the air scoop through which air enters the engine intake manifold; and the desired air-to-fuel ratio 78, also referred to herein as the dimensionless number $AF_D$, which specifies the operator's desired air-to-fuel ratio be maintained throughout engine run time according to the present invention. A single communication line 63 is designated for the output control signal 63 sent to the relief valve 51. In preferred embodiments, signal 63 may be a continuous or pulse-width modulated 0-12 VDC or 0-24 VDC signal, although other embodiments are possible in which signal 63 comprises an electrical current. Power to the module 60 is provided to input pin 79, preferably a 12 or 24 VDC feed from the vehicle electrical system.

In a system or process according to the invention, the operator need only specify the dimensionless number $AF_D$ (the "Jackson number" named for the inventor) for a selected fuel or mixture of fuels to achieve a desired fuel efficiency for engine operation. In some cases, the operator may specify an $AF_D$ that will cause the fuel supply to run rich, that is, with a slightly greater amount of fuel than is needed to achieve optimal fuel efficiency, to allow the fuel flow to help cool the engine. In other cases, the operator may specify an $AF_D$ that is more lean. In any case, the invention allows the operator to adjust $AF_D$ in the control algorithm to customize engine operation for different fuels, fuel mixtures, and other circumstances.

Figure 4:
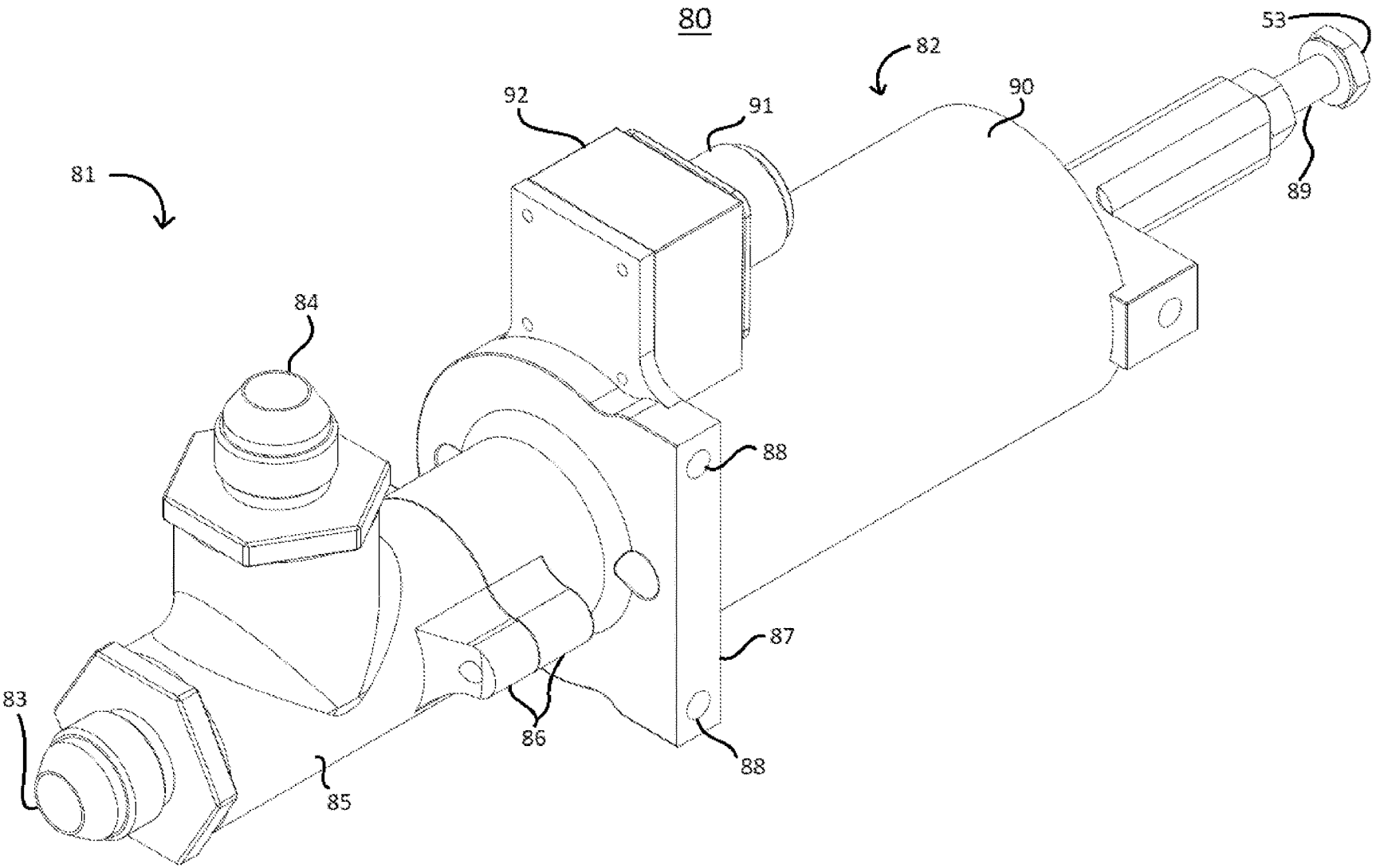
FIG. 4 is a perspective view of one embodiment for an electrically controlled proportional relief valve for use in a high volume electronic fuel injection system according to the invention.

FIG. 4 shows a perspective view of one embodiment for an electrically controlled proportional relief valve 80 for use in a high volume electronic fuel injection system according to the invention. The valve 80 may serve as relief valve 51 in system 50. For high-volume fuel line applications, using a blend of nitromethane and methanol, valve 80 is configured to handle pressures up to about 500 psi. Valve 80 has a hydraulic end 81 constructed for controlling fuel flow, and an actuator end 82 constructed for converting electrical energy into mechanical energy for adjusting fuel flow through the hydraulic end. At the hydraulic end 81, an inlet port 83 is constructed for connecting to, and receiving fuel flow from, a fuel line. An outlet port 84 is constructed for connecting to a fuel line, and for directing fuel out of the valve. Ports 83 and 84 may formed according to standard dimensions for pipe fittings. Valve body 85 contains the valve internals and is constructed for directing or obstructing fluid flow from the inlet port 83 to the outlet port 84. The valve internals include a valve seat and a moveable gate configured to vary the fuel flow from inlet to outlet as a function of linear position of the gate with respect to the seat.

The hydraulic end 81 is configured for mechanical connection, e.g. by means of brackets 86 and conventional fastening hardware, to an adapter 87 that is formed on the actuator end 82 of the valve 80. Adapter 87 may include mounting holes 88 configured for mounting the valve within an engine compartment. A spring-loaded piston 89 is installed within the actuator end 82 and is coupled to the moveable gate at a location within the adapter 87. The piston is moveable in a longitudinal direction to transmit motive force to the moveable gate. In one embodiment, piston 89 is configured for about one inch of total linear movement within the valve 80.

Valve 80 may be constructed as either normally open or normally closed. In normally open construction, when the valve is not energized, the spring force against the piston forces the gate away from the valve seat to fully open the valve. In normally closed construction, the spring force against the piston causes the gate to fully engage the valve seat and close the valve. For illustration purposes only, valve 80 will be described hereafter as being normally closed.

The actuator end 82 of the valve 80 includes an armature 90, an electrical connector 91, and an electrical junction box 92. Armature 90 encloses a linear DC motor that operates as a voice coil actuator to convert a voltage to a linear position. The voltage is provided by control signal 63, which is received at connector 91, and connected across the terminals of the linear motor within the junction box 92. Connector 91 may be of conventional design, such as any of various mil-spec connectors. So connected, control signal 63 governs the position of piston 89 within the armature 90, and thereby governs the amount of fluid flow through the valve 90.

Valve 80 includes an idle adjust 53, which is configured to limit the travel of piston 89, that is, how far piston 89 can open the valve gate. This limitation ensures that at least a minimum amount of flow needed to maintain the engine in a idle state will flow to the engine nozzles and not through the valve 80. Idle adjust 53 may be configured for manual adjustment, for example, using a rotatable threaded connection of hardware that is configured to mechanically limit the travel of piston 89 into the armature 90.

Figure 5:
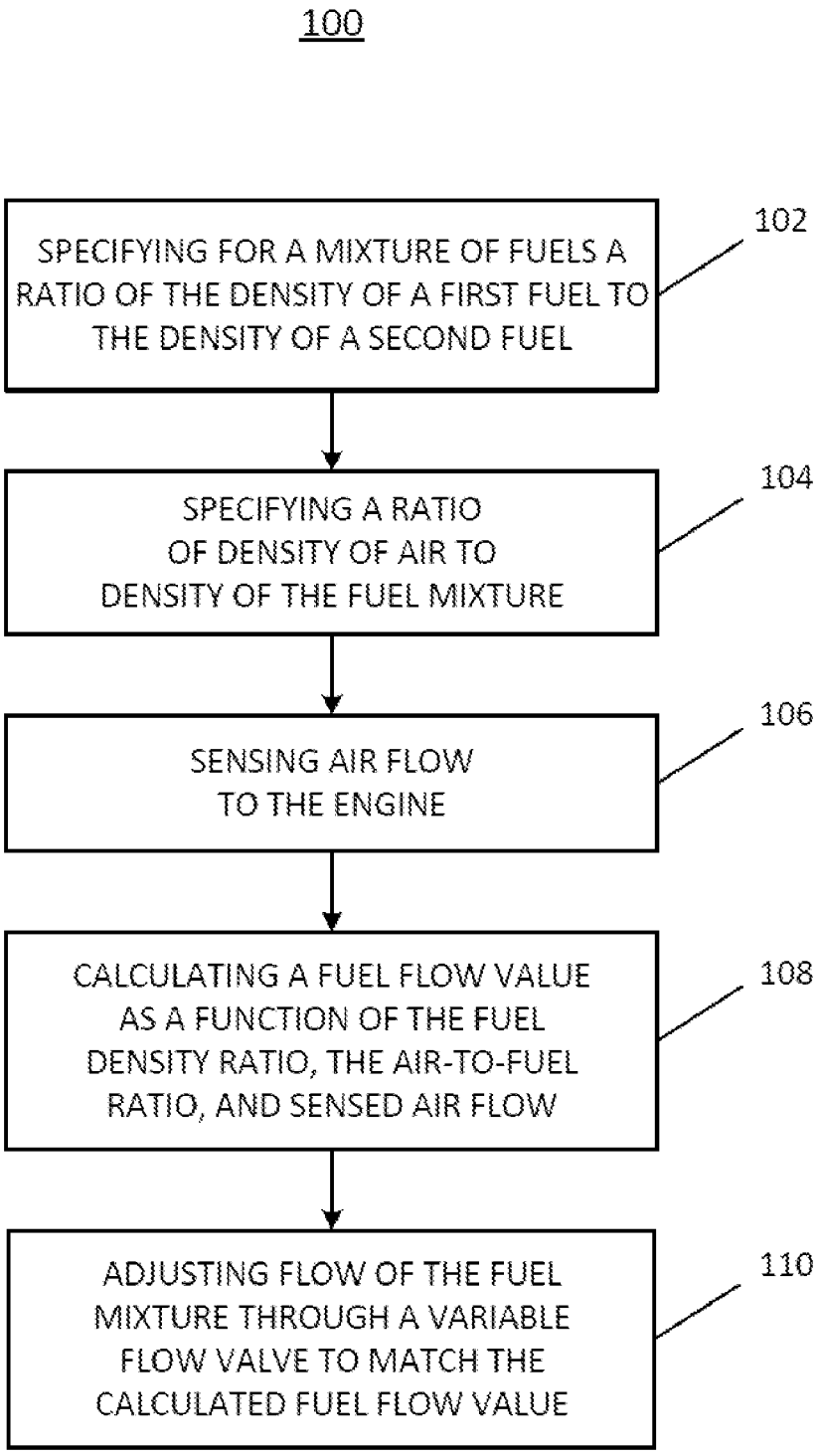
FIG. 5 is a process flow diagram illustrating one embodiment according to the invention for optimizing fuel efficiency in an internal combustion engine.

FIG. 5 is a process flow diagram illustrating one embodiment of a method 100 according to the invention for optimizing fuel efficiency in an internal combustion engine. Method 100 illustrates salient steps of the process, and should be interpreted in the context of the system embodiments described above. Method 100 begins at step 102. In this step an operator specifies, for a fuel mixture comprising a first fuel and a second fuel, a ratio of the density of the first fuel to the density of the second fuel. The operator may specify this ratio, for example, by manually entering a value representing the ratio into the memory of a data acquisition and control loop such as loop 52, by means of a user interface 65. Next, in step 104, the operator specifies a ratio of density of air to density of the fuel mixture. This ratio is the dimensionless Jackson number $AF_D$ that represents the desired air-to-fuel ratio, and which in many cases may be determined empirically by the operator using trial and error. The next step 106, sensing air flow to the engine, may be performed automatically by means of an air flow sensor at the engine air intake scoop.

The next step 108 is a calculating step, preferably performed automatically by the data acquisition and control loop calculating a fuel flow value as a function of (1) the ratio of the density of the first fuel to the density of the second fuel, (2) the desired ratio of density of air to density of the fuel mixture, and (3) the sensed air flow. In the final step 110, also preferably performed automatically by the data acquisition and control loop, the flow of fuel through a variable flow valve is adjusted to match the calculated fuel flow value. This step ensures that fuel flow to the engine nozzles will have the desired air-to-fuel ratio $AF_D$.

More elaborate methods according to the invention may be derived from a reading of the foregoing disclosure without modeling each of the steps in a separate flow chart. In one such embodiment, method 100 may include the following additional steps: sensing one or more of a humidity, pressure, and temperature, and calculating the fuel flow value as a function of one or more of sensed humidity, sensed pressure, and sensed temperature. In a more specific embodiment, for use with an engine fuel mixture composed of nitromethane and methanol, method 100 may include a step for calculating the fuel flow value, $FF_E$, according to:

$$FF_E=[AF_E*((Y1*D_V)+(Y2*D_0))]/[AF_D*((Y3*NM\%)+(Y4*(100-NM\%)))]$$

where $FF_E$ is fuel flow to the engine in gpm;

$AF_E$ is air flow to the engine in $ft^3$/min;

$D_V$ is water vapor density in lbs/$ft^3$;

$D_0$ is dry air density in lbs/$ft^3$;

$AF_D$ is the specified air-to-fuel ratio, a dimensionless number;

NM % is the specified ratio of the first fuel density to the second fuel density; and Y1=about 18; Y2=about 137.885; Y3=about 5.776; and Y4=about 2.1095.

Still other embodiments of a process according to the invention are possible. For example, the step 110 may further include variable energization of the flow control valve by an ECU. In another embodiment, step 108 may further include calculating the fuel flow value as a function of water vapor density and dry air density.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An electronic fuel injection system for an internal combustion engine, comprising:

a fuel pump having an outlet and having an inlet in fluid communication with a fuel tank;

a throttle valve coupled between the outlet of the fuel pump and an intake manifold of the engine;

a throttle bypass line coupled to the outlet of the fuel pump upstream of the throttle valve;

an electrically controlled variable flow valve coupled between the bypass line and the fuel tank;

an electronic control unit (ECU) having an output electrically coupled to the variable flow valve; and a fuel flow sensor downstream of the throttle valve;

wherein the ECU is configured to control fuel flow through the variable flow valve based on fuel flow sensed by the fuel flow sensor.

2. The system of claim 1, wherein the ECU is further configured to control the fuel flow according to an operator-specified air-to-fuel.

3. The system of claim 2, wherein the air-to-fuel ratio is a value stored in a memory readable by the ECU.

4. The system of claim 2, wherein the operator-specified air-to-fuel ratio is a function of the ratio of a first fuel density to a second fuel density.

5. The system of claim 1, wherein the ECU further comprises a microprocessor and a memory, the memory storing a program executable by the microprocessor, and a user interface configured for entry of one or more values by an operator into the memory, the one or more values readable by the program, and the program configured to generate an optimal fuel flow value as a function of the one or more values.

6. The system of claim 5, further comprising a barometric pressure sensor and wherein the optimal fuel flow value is a function of pressure sensed by the barometric pressure sensor.

7. The system of claim 5, further comprising a temperature sensor, wherein the temperature sensor senses manifold temperature of the engine and wherein the optimal fuel flow value is a function of the sensed engine manifold temperature.

8. The system of claim 5, wherein the program is configured to generate the optimal fuel flow value, $FF_E$, according to:

$$FF_E=[AF_E*((Y1*D_V)+(Y2*D_0))]/[AF_D*((Y3*NM\%)+(Y4*(100-NM\%)))]$$

where $FF_E$ is fuel flow to the engine in gpm;

$AF_E$ is air flow to the engine in $ft^3$/min;

DV is water vapor density in lbs/$ft^3$;

$D_0$ is dry air density in lbs/$ft^3$;

$AF_D$ is the operator-specified air-to-fuel ratio, a dimensionless number;

NM % is density ratio of nitromethane to methanol in a mixture of fuel; and

Y1=about 18; Y2=about 137.885; Y3=about 5.776; and Y4=about 2.1095.

9. A system for controlling electronic fuel injection for an internal combustion engine, comprising:

an electronic control unit (ECU) having a microprocessor and a memory storing a program executable by the microprocessor;

the program configured to generate an optimal fuel flow value as a function of a ratio of a first fuel density to a second fuel density.

10. The system of claim 9, wherein the ECU is configured to generate a variable control signal representing the optimal fuel flow value and transmit the variable control signal to a proportional electrical relief valve.

11. The system of claim 9 further comprising a fuel flow sensor configured to transmit a feedback signal to the ECU.

12. The system of claim 9, wherein the first fuel density is nitromethane density and wherein the second fuel density is methanol density.

13. The system of claim 9 further comprising:

one or more of a humidity sensor, a pressure sensor, a temperature sensor, an air flow sensor; and wherein the program is further configured to generate the optimal fuel flow value as a function of one or more of sensed humidity, sensed pressure, sensed temperature, and sensed air flow.

14. The system of claim 9 wherein the program is configured to generate the optimal fuel flow value, $FF_E$, according to:

$$FF_E=[AF_E*((Y1*D_V)+(Y2*D_0))]/[AF_D*((Y3*NM\%)+(Y4*(100-NM\%)))]$$

where $FF_E$ is fuel flow to the engine in gpm;

$AF_E$ is air flow to the engine in $ft^3$/min;

DV is water vapor density in lbs/$ft^3$;

$D_0$ is dry air density in lbs/$ft^3$;

$AF_D$ is the operator-specified air-to-fuel ratio, a dimensionless number;

NM % is the operator-specified ratio of a first fuel density to a second fuel density; and Y1=about 18; Y2=about 137.885; Y3=about 5.776; and Y4=about 2.1095.

15. A method for optimizing fuel flow in an internal combustion engine, comprising:

specifying, for a fuel mixture comprising a first fuel and a second fuel, a ratio of the density of the first fuel to the density of the second fuel;

specifying a desired ratio of density of air to density of the fuel mixture;

sensing air flow to the engine;

calculating a fuel flow rate as a function of (1) the ratio of the density of the first fuel to the density of the second fuel, (2) the desired ratio of density of air to density of the fuel mixture, and (3) the sensed air flow; and delivering the fuel mixture to the engine at the calculated fuel flow rate.

16. The method of claim 15 further comprising:

sensing one or more of a humidity, pressure, and temperature; and calculating the fuel flow rate as a function of one or more of the sensed humidity, the sensed pressure, and the sensed temperature.

17. The method of claim 15 further comprising calculating the fuel flow rate, $FF_E$, according to:

$$FF_E=[AF_E*((Y1*D_V)+(Y2*D_0))]/[AF_D*((Y3*NM\%)+(Y4*(100-NM\%)))]$$

where $FF_E$ is fuel flow to the engine in gpm;

$AF_E$ is air flow to the engine in $ft^3$/min;

DV is water vapor density in lbs/$ft^3$;

$D_0$ is dry air density in lbs/$ft^3$;

$AF_D$ is the specified air-to-fuel ratio, a dimensionless number;

NM % is the specified ratio of the first fuel density to the second fuel density; and Y1=about 18; Y2=about 137.885; Y3=about 5.776; and Y4=about 2.1095.

18. The method of claim 15 further comprising:

storing the ratio of the density of the first fuel to the density of the second fuel as a first value in an electronic memory;

storing the desired ratio of density of air to density of the fuel mixture as a second value in the electronic memory; and automatically calculating, by a processor reading the first and second stored values and executing a program stored in the memory, the fuel flow rate.

19. The method of claim 18, wherein the processor automatically adjusts the flow rate of the fuel mixture by energization of a variable flow valve until sensed flow received by the processor matches the calculated fuel flow rate.

20. The method of claim 15 further comprising calculating the fuel flow rate as a function of water vapor density and dry air density.

* * * * *